US010538920B2

(12) United States Patent
Sager

(10) Patent No.: US 10,538,920 B2
(45) Date of Patent: Jan. 21, 2020

(54) AGENT DISPERSING METHOD

(76) Inventor: Karen M. Sager, Ridgewood, NJ (US)

( * ) Notice: Subject to any disclaimer, the term of this patent is extended or adjusted under 35 U.S.C. 154(b) by 0 days.

(21) Appl. No.: 13/336,448

(22) Filed: Dec. 23, 2011

(65) Prior Publication Data

US 2013/0160377 A1 Jun. 27, 2013

(51) Int. Cl.

| | |
|---|---|
| ***E04D 13/076*** | (2006.01) |
| ***E04D 13/064*** | (2006.01) |
| ***E04D 13/00*** | (2006.01) |
| *E04D 13/072* | (2006.01) |
| *E04D 13/158* | (2006.01) |

(52) U.S. Cl.

CPC ..... *E04D 13/002* (2013.01); *E04D 13/076* (2013.01); *E04D 13/064* (2013.01); *E04D 13/0725* (2013.01); *E04D 13/158* (2013.01)

(58) Field of Classification Search

CPC . E04D 13/076; E04D 13/064; E04D 13/0725; E04D 13/158; E04D 13/00

USPC ..... 52/12, 11, 101

See application file for complete search history.

(56) References Cited

U.S. PATENT DOCUMENTS 3,057,481 A * 10/1962 Pall ..... B01D 39/12 210/490
3,428,183 A * 2/1969 Bristow ..... E04D 13/076 210/474
4,841,686 A * 6/1989 Rees ..... E04D 13/076 210/474
4,907,381 A * 3/1990 Ealer ..... E04D 13/076 52/12
5,592,783 A * 1/1997 Jones ..... E04D 13/076 210/474
5,619,825 A * 4/1997 Leroney ..... E04D 13/0725 248/48.1
6,598,352 B2 * 7/2003 Higginbotham ..... 52/12
6,951,077 B1 10/2005 Higginbotham
7,174,688 B2 2/2007 Higginbotham
7,191,564 B2 3/2007 Higginbotham
7,913,458 B2 * 3/2011 Higginbotham ..... 52/12
8,006,438 B2 8/2011 Higginbotham
RE42,896 E * 11/2011 Higginbotham ..... 52/12
8,595,985 B1 * 12/2013 Feldhaus ..... E04D 13/076 52/12
9,127,463 B1 * 9/2015 Feldhaus ..... E04D 13/0725
2003/0046876 A1 * 3/2003 Higginbotham ..... 52/11
2004/0031222 A1 * 2/2004 Porat ..... 52/302.1
(Continued)

*Primary Examiner* — Phi D A
(74) *Attorney, Agent, or Firm* — Stuart Smith; Roberts Mlotkowski Safran Cole & Calderon, P.C.

(57) ABSTRACT

The method includes dispersing copper or other material ions through the water receiving area of a gutter guard for the prevention of moss or mold growth. The method includes the utilization of thread(s) sewn into or embroidered onto or otherwised affixed to or immediately preceding the water receiving areas of a gutter guard, such thread(s) being comprised of moss killing materials. The thread(s) comprise only a portion of the water receiving area, so if corrosive elements form and wash over the water receiving area, they will be in sufficient amounts to kill moss but not in so great an amount as to clog any water receiving apertures. The method includes the utilization of staples or other objects comprised of copper or other moss killing materials fastened to or adhered or welded to the body or water receiving areas of a gutter guard or areas immediately preceding such.

17 Claims, 9 Drawing Sheets

(56) References Cited

U.S. PATENT DOCUMENTS

| | | | | |
|---|---|---|---|---|
| 2005/0102909 | A1* | 5/2005 | Carpenter | E04D 13/076 52/11 |
| 2006/0248805 | A1* | 11/2006 | Gentry | E04D 13/076 52/14 |
| 2007/0055007 | A1* | 3/2007 | Pagel et al. | 524/569 |
| 2007/0068092 | A1* | 3/2007 | Fraser, Jr. | 52/97 |
| 2009/0000210 | A1* | 1/2009 | Barnett | 52/12 |
| 2009/0288349 | A1* | 11/2009 | Wootton | 52/12 |
| 2010/0251626 | A1* | 10/2010 | Roque Alonso | 52/12 |
| 2011/0252723 | A1* | 10/2011 | Devery | 52/173.3 |
| 2011/0308557 | A1* | 12/2011 | Kaiser | 134/56 R |

* cited by examiner

AGENT DISPERSING METHOD

FIELD OF THE INVENTION

The following invention relates to gutter guard systems which are adapted to be placed on rain gutters such as those provided on the eaves of a house or other structure to collect and direct water away from a building while preventing debris from collecting within the gutter. More particularly, this invention relates to methods of fitting any gutter guard system or method with clips so that they may optionally include a heat source to melt ice, snow or other frozen water that has formed so that the system can function when frozen water is encountered adjacent the system. This invention also relates to methods of incorporating copper or other moss killing elements in a ratio of element to screen or water receiving area that ensures the killing of moss or mold but that does not cause clogging of the water receiving area due to an over abundance of corrosive or oxidized elements leaching from the moss killing material. This invention also provides a means of drawing cables or other elements through a top surface of gutter guards and/or of dispersing elements down through and into an underlying gutter.

BACKGROUND OF THE INVENTION

The problem of debris collecting within gutters is well documented. Many different forms of gutter guard systems have been developed to prevent debris from collecting within the gutter. Some such gutter guards are of a type that provides merely a solid plane with holes therein so that water can pass through but debris cannot. Such simple systems suffer from the serious drawback that the holes must be large enough that water will pass through rather than adhering due to surface tension and adhesion forces to edges of the holes as noted by Higginbotham in U.S. Pat. No. 6,598,352. On the other hand, the holes must be small enough to prevent debris from passing through. Experience has shown that the compromises required with such simple gutter guard systems lead to serious deficiencies in the performance of such gutter guard systems, either not effectively allowing water to pass through or too often allowing debris to pass through or lodge within the holes.

Other gutter guard systems utilize solid planes of material with a sharp curve in the surface which water can adhere to, but which debris will not adhere to. Water adheres to the sharply curving metal portion and is routed in a curving path into the gutter, while debris falls off of such a gutter guard. Such gutter guards have advantages and disadvantages which are well documented in the prior art: chiefly, as taught by Higginbotham in U.S. Pat. No. 6,598,352: oil from shingles eventually coats and waterproofs such systems requiring that the be manually and periodically cleaned.

A third form of gutter guard known in the prior art and first introduced in U.S. Pat. No. 6,598,352 by Higginbotham utilizes a fine mesh filter element which has sufficiently small holes therein that debris cannot pass through and this fine mesh filter element, which is formed as a thin flexible screen material, is supported upon a rigid underlying support structure that holds the filter element in place, with the underlying support structure having holes therein to route water passing through the filter element down through the support structure and into the gutter. Such two part filter and support structure gutter guards allow substantially all debris to be prevented from the gutter while allowing high volumes of water to be directed into the gutter.

A common problem experienced by all different types of gutter guard systems in certain environments is that when freezing temperatures are encountered, water on and adjacent to the gutter guard will freeze, and prevent water from passing into the gutter. When such gutter guard performance is inhibited, freeze and thaw cycles can result in dangerously large icicles forming off of edges of the gutters or other portions of the roof. Freeze-thaw cycles that occur may result in ice dam formation. Additionally, the weight of the snow and ice on the gutter guard can potentially damage the gutter or gutter guard.

One solution for de-icing gutters and gutter guards is the use of heat cables. In at least one case, a gutter guard of the curving metal cover type has had such a heat cable affixed into the gutter guard so that the surface of the gutter guard could conduct heat from the resistance heating wire to melt frozen water off of the gutter. Such a system is described in U.S. Pat. No. 7,448,167 to Bachman, incorporated by reference herein in its entirety.

As noted by Lenney in his U.S. Patent application 20100287846 incorporated by reference herein in its entirety: "Because such curving metal style gutter guards have a single layer of metal forming the entire gutter guard, the wires can simply heat surfaces which come in contact with the frozen water. However, such a solution is not applicable to multi-part gutter guard systems, such as those described below which include a filter element and an underlying support structure. In particular, filter elements are beneficially formed from materials which resist corrosion. Such materials are also generally low in thermal conductance. For instance, of all metals, stainless steel is known for its low corrosion characteristics, but is also known for being very low in thermal conductance, especially for a steel alloy. Such low thermal conductance of screen materials can require either excessive electric power to be routed to the gutter guard system to cause ice thereon to be melted, or suffers from lack of sufficient heat transfer, so that only limited melting of frozen water occurs."

A drawback of the type of heating system offered by Lenney and described in his application is that much of his water receiving area is lost due to his utilization of a solid cover over the heating element. Another drawback of the method disclosed by Lenney is the high cost of manufacture and of installation of the product his application is associated with, "Ice Blaster™", known to be as much as $40.00 (forty dollars) per linear foot in the field. Yet another drawback of the Lenney system is that the solid cover he discloses lessens the intensity of heat that could be delivered to the underside of ice overlying the cover versus heat radiating from a heating cable through a screen or mesh. Yet another drawback of the Lenney system is that the heating cable's placement and heat disbursement is limited to the narrowly defined covered channel he teaches. Yet another drawback of the Lenney system is that, in areas where icing is not a problem, the system offers only greater cost with less water receiving and redirecting performance. Yet another drawback of the Lenney system is that the heating cable is not easily installed or, if need be for repair, removed in that it requires affixing the solid channel cover and entire gutter guard system, by screws, to the front top lip of a rain gutter.

Accordingly, the present invention addresses a need that exists for a gutter guard system that is easily and readily installed, that may be installed as a retrofit to existing gutter guards, that is inexpensive, that does not interfere with micro-mesh products' ability to receive and redirect water, and that allows for the placement of a heating cable in more than one location.

SUMMARY OF THE INVENTION

The present invention encompasses clips, that may be solid or water permeable, and that are affixed to the underside of water-receiving areas of gutter guards, with their open ends facing any direction but preferably forward, serving as fixed points whereby heating cables or other elements may be channeled to and routed through. The clips may be of any shape and comprised of any amount of components, levels, or extending and/or securing features most readily allowing attachment to a particular type of gutter guard: flat perforated planes or meshes or expanded metal, or curved planes, or multi-level perforated body and overlying screen systems, systems that employ downward extending inseams or channels as water directing areas, and other known systems.

The clips may be fastened or stapled through or affixed to the top of gutter guards and they, or their fasteners, can be comprised of copper or other mold and moss killing materials.

The present invention also encompasses the employment of a copper or other material thread or plurality of threads interwoven into, or embroidered onto, or otherwise attached or adjacent to; cloth or sponge or mesh gutter guard areas of a gutter guard for the purpose of dispersing ions during periods of rain to prevent the growth of moss, mold, or mildew on the gutter guard.

The present invention also encompasses the utilization of holes or grommets, which can themselves be made of copper, in the top plane of gutter guards through which to pull heating or other cables.

OBJECTS OF THE INVENTION

Accordingly, a primary object of the present invention is to provide readily adaptable and readily installed pathways by means of securing clips to the underside of gutter guards either during their manufacture, during installation in the field, or as a retrofit process of attaching the inexpensive clips to any existing gutter guard.

Another object of the present invention is to allow gutter guard systems to melt frozen water thereon.

Another object of the present invention is to provide a gutter guard including a filter element and an underlying support structure of clips which secure a heating cable to conduct heat from a heat source through the underlying support structure to the filter element so that the filter element can melt frozen water thereon such system being inexpensive to manufacture and readily installed by simply lifting the front of the gutter guard and pushing a heating cable into place.

Another object of the present invention is to provide a system for keeping gutters operating in freezing conditions and to prevent icicle formation or damage to the gutter from the weight of frozen water loads and to reduce ice dam buildup.

Another object of the present invention is to provide a method for de-icing a gutter that also prevents debris from entering the gutter.

Another object of the present invention is to provide easy access for the replacement or repair of heating cables utilized by a gutter guard.

Another object of the present invention is to allow a gutter guard to offer a heating capability without limiting its ability to receive and redirect water.

Another object of the present invention is to use the melted snow or ice and to harvest it for water collection during the time of year when rainwater harvesting would not be practical.

Another object of the present invention is to provide a method, by means of clips or thread(s) comprised of copper, or other material, that disperses copper ions or other material elements that serve to prohibit the growth of moss, mold, or mildew on a gutter guard.

Another object of the present invention is to provide a method of killing the moss, mold or mildew spores in the initial filtration step at the gutter when a gutter guard is part of a rainwater harvesting system.

Another object of the present invention is to provide an access hole or grommet in the top are of a gutter guard through which to draw cables or through which to insert or disperse elements into an underlying gutter.

Other further objects of the present invention will become apparent from a careful reading of the included drawing figures, the claims and detailed description of the invention.

DETAILED DESCRIPTION OF AN EMBODIMENT

Referring to (FIG. 1) there is illustrated a gutter guard 1 with a screened main body and water receiving area 2. Also illustrated are clips 3 secured beneath the screened body 2 by adhesion, pop rivet, tab, or any common fastening method.

The open end of the clips 3A face forward and serve to receive and secure a heating cable or other element.

Figure 2:
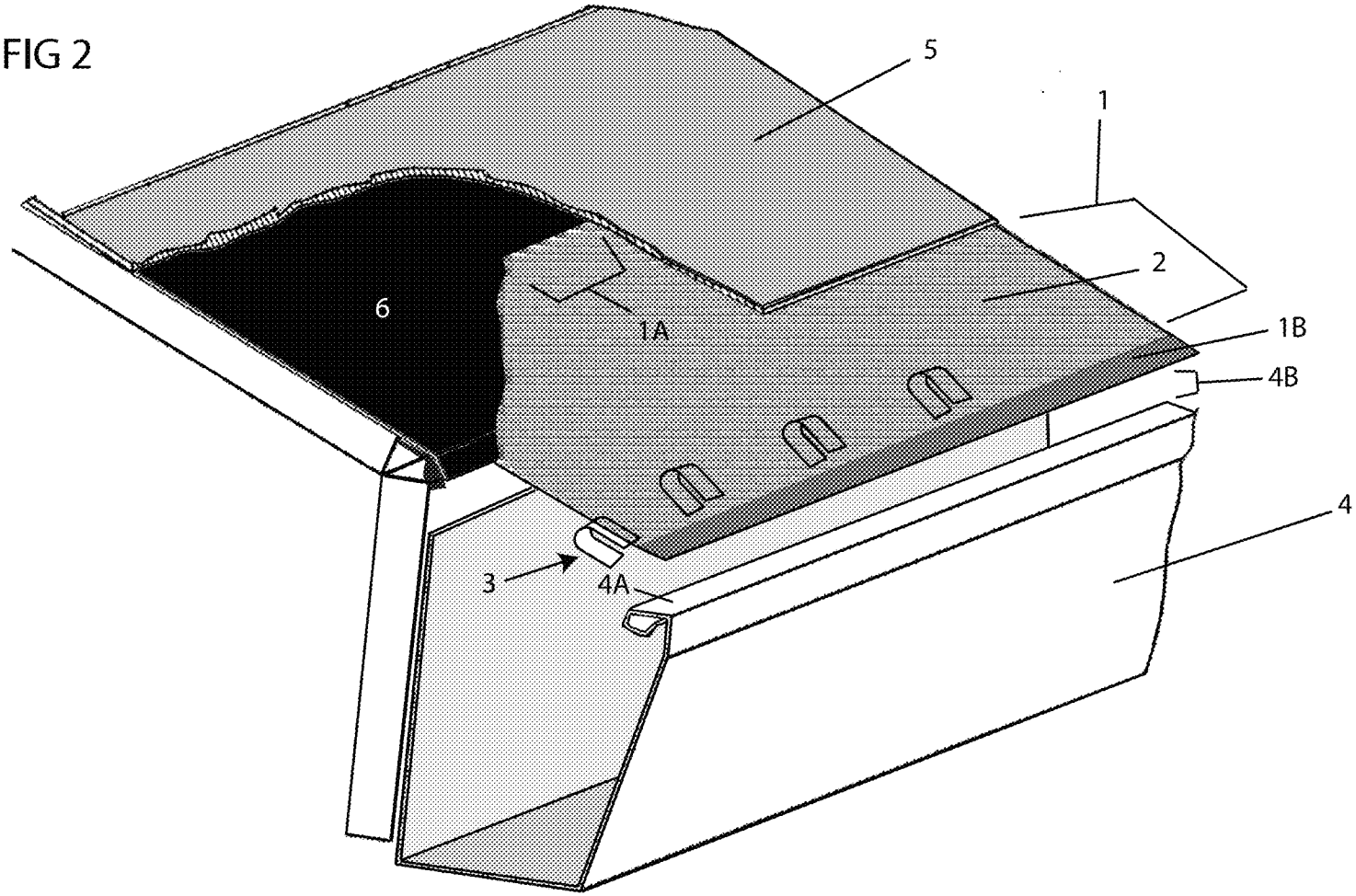

Referring to (FIG. 2) there is illustrated a gutter guard 1 whose rear lateral edge 1A is inserted and sandwiched between a roof underlayment 6 and roof covering 5. As illustrated, the gutter guard 1 has clips 3 attached to its underside. The placement of the clips 3 immediately beneath the surface 2 of the gutter guard and near the gutter guard's front lateral edge 1B and facing forward allows for easy installation of a heating cable or other element during installation of the gutter guard in that the gutter guard only need be lifted slightly up from the gutter creating just enough open air space 4B to allow for the insertion of a heating cable into the clips 3. Once the cable is inserted the gutter guard 1 may be pulled forward and downward and secured to the front top lip 4A of the gutter 4.

Figure 3:
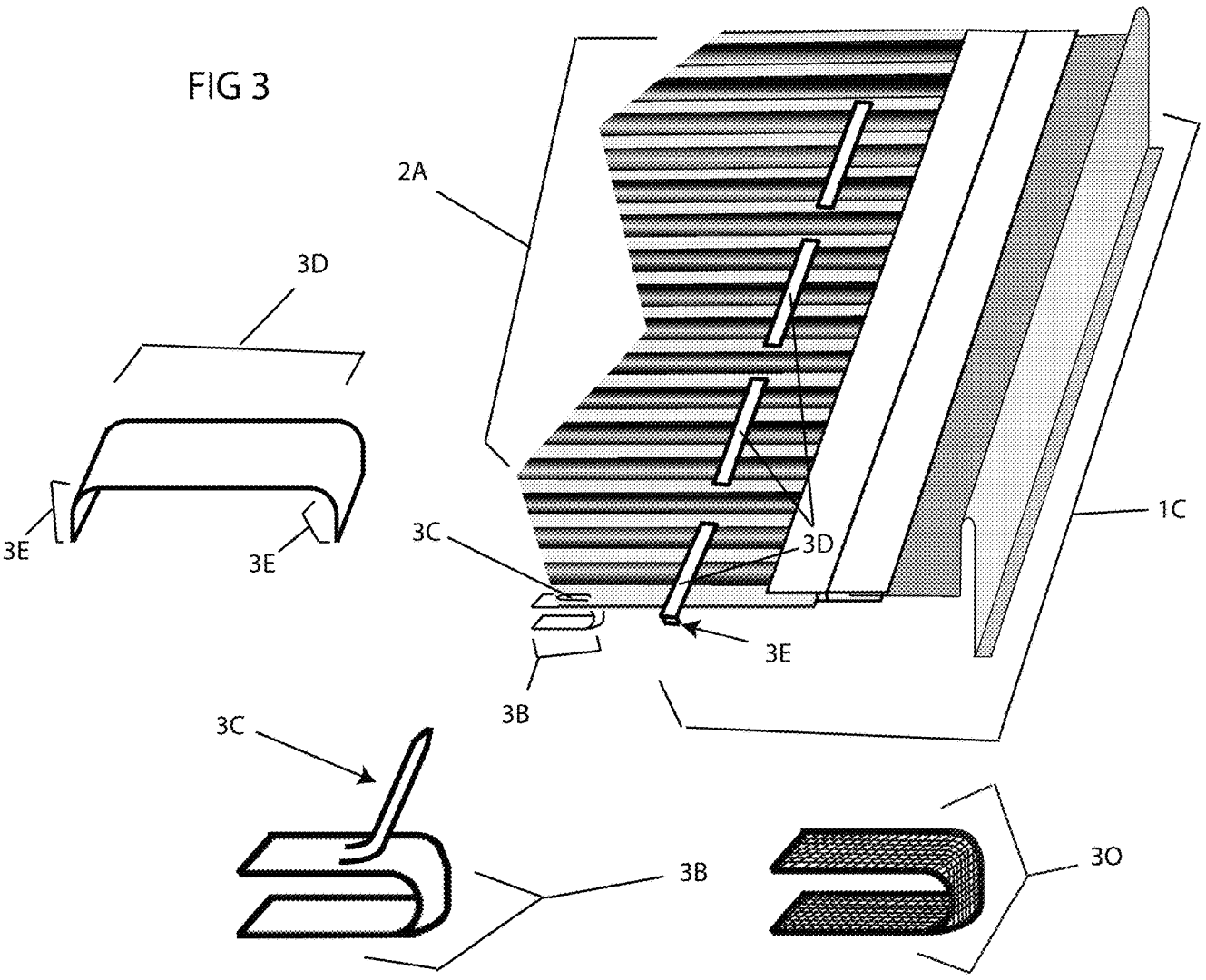
Figure 5:
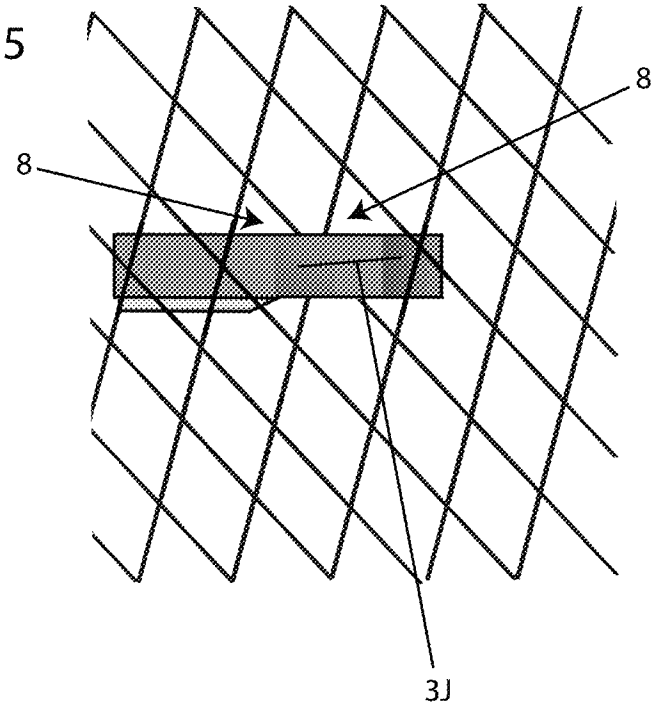
Figure 6:
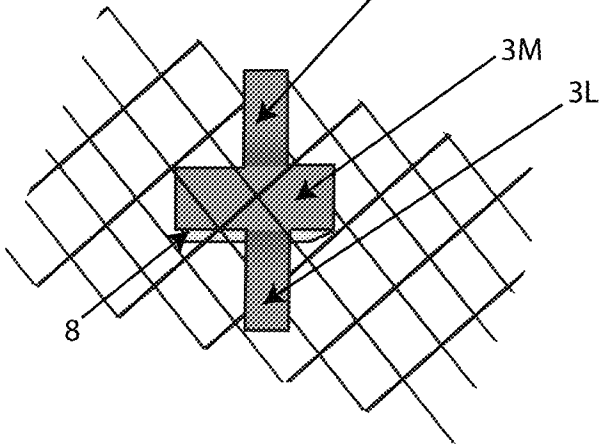
FIG. 6. A view of a clip whose side tabs are inserted through and installed within the openings of an expanded metal section of a gutter guard.
Figure 7:
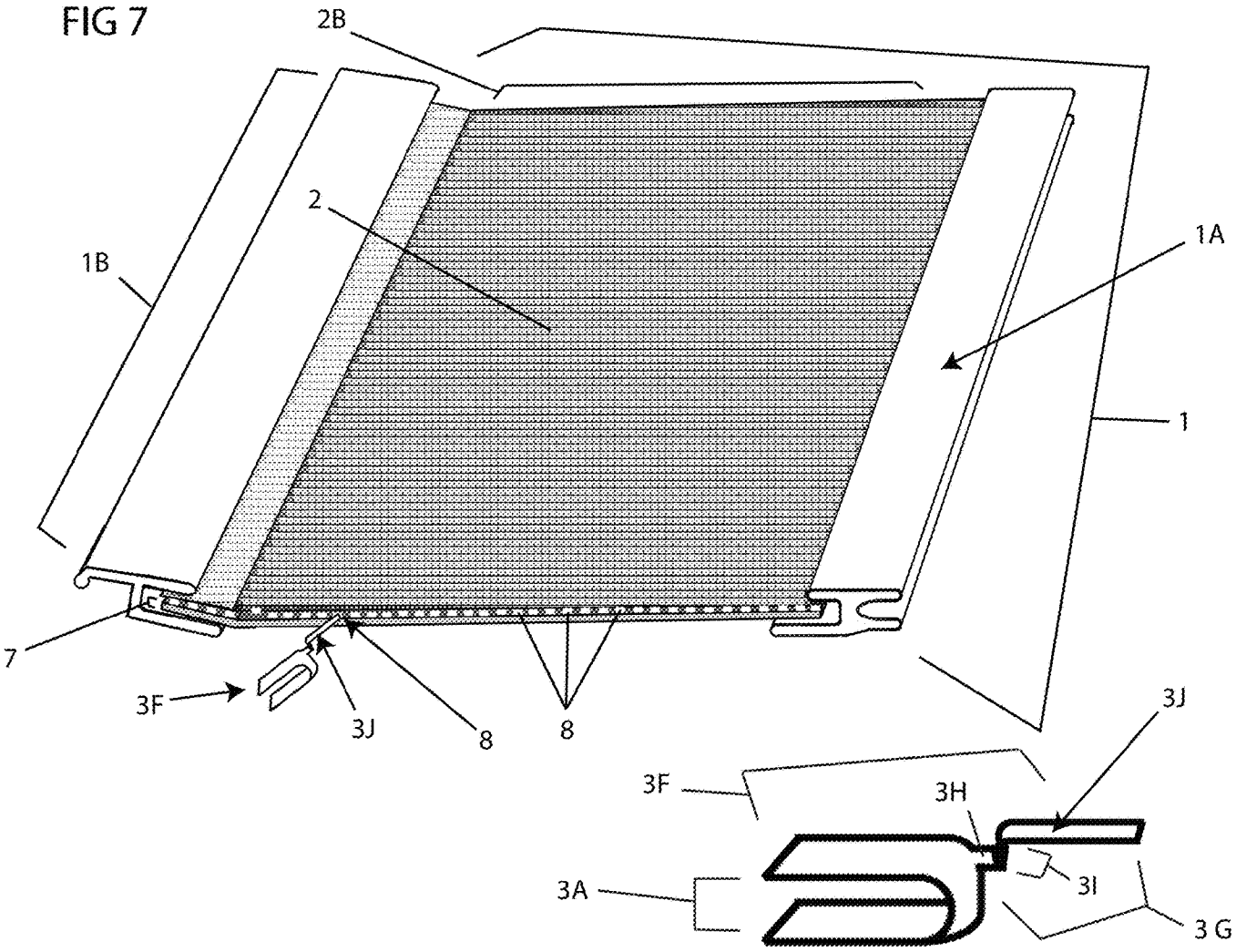
FIG. 7. A view of a gutter guard comprising a fine mesh screen overlying an expanded metal support skeletal structure illustrating a clip being inserted into expanded metal openings And a view of a clip with a multi-level rear tab that extends rearward from the upper plane of the clip.
Figure 8:
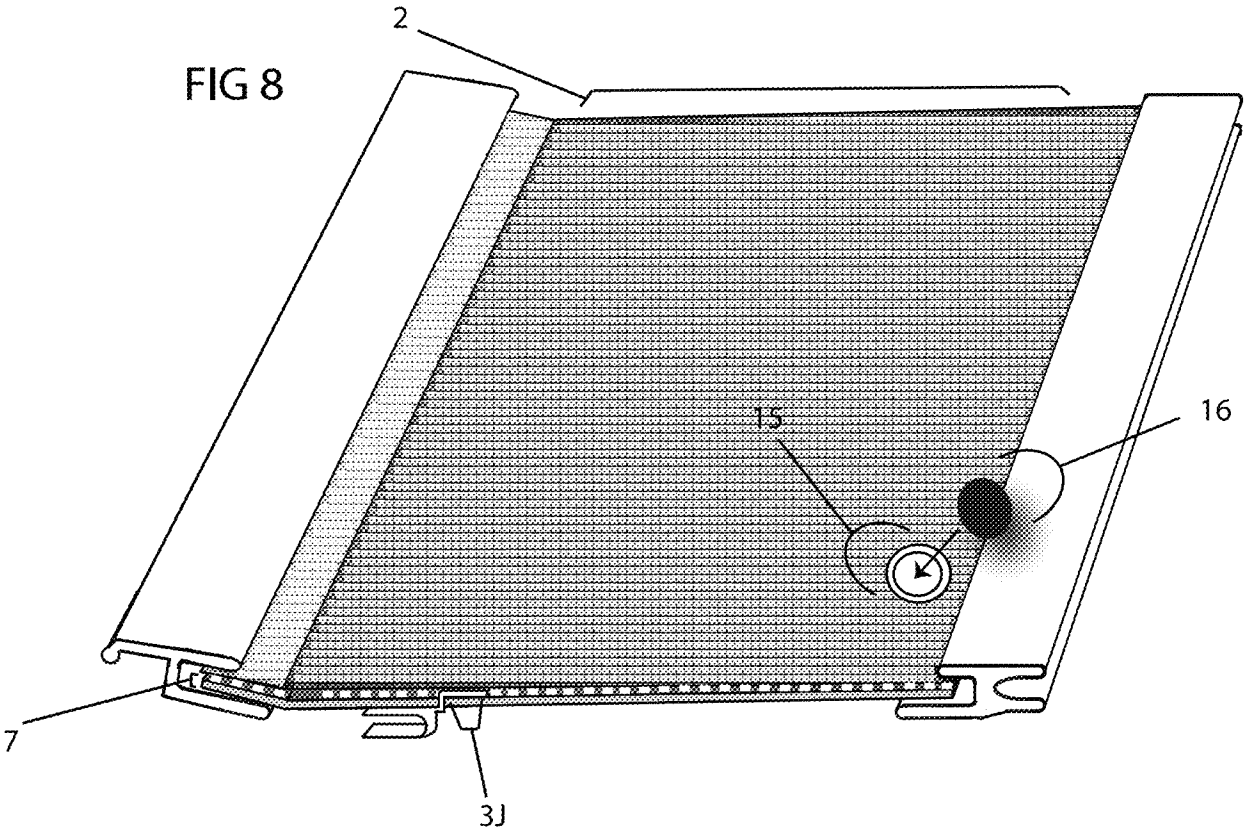
FIG. 8. A view of a gutter guard comprising a fine mesh screen overlying an expanded metal support skeletal structure illustrating a clip fully inserted into expanded metal openings and illustrating a grommet with cover present in the top plane of a screened gutter guard.

Referring to (FIG. 3) there is illustrated a cut-a-way rear section 1C of a gutter guard with a fastening clip 3B and a fastening clip 3D attached to the gutter guard's corrugated screened main body and water receiving area 2A. 3C is a piercing tab that extends upward from the clip enabling the clip to pierce the corrugated screen of the gutter guard. The tab 3C is then pressed downward securing the clip 3B to the under surface of the corrugated screened body 2A of the gutter guard 1C: it is understood that this is an illustration of a simple and single method representative of multiple methods (not shown but known in prior art) that may be utilized for securing a clip to the underside of a gutter guard's body; other methods may include adhesives, weld joints, etc. Referring to (FIGS. 5 and 6) another means of securing clips by means of perforations or openings present in a gutter guard is illustrated: Referring specifically to (FIG. 7) a gutter guard 1 is illustrated comprising a front lateral edge 1B, an intermediate body portion 2B said intermediate body portion being comprised of screen 2 over expanded metal 7, and a rear lateral edge 1A. The clip 3F exhibits a rear tab 3G comprised of a lower plane 3H extending from the main body of the clip, an intermediate and upward extending connecting plane 3*i*, and a rear ward extending an upper plane 3J. Plane 3J may be inserted up and through expanded metal openings 8, the clip then pushed rearward until, referring now to (FIGS. 5,8) plane 3J rests on top of the expanded metal 7 and beneath an overlying filtering screen 2. Referring specifically to (FIG. 5), it is shown that plane 3J may insert up and through an opening or perforation, rest on top of the plane, and then distend downward through an adjacent opening. Referring specifically to (FIG. 6) it is shown that planes 3K and 3L may extend sideways from an upper plane 3M of a clip and similarly secure the clip by lodging within the openings 8.

Referring again to (FIG. 3) a clip 3O is illustrated comprised of screen mesh or other water permeable material. Such porous material may be desirable to prevent the forward tracking of water along the top surface of a clip by allowing for water to travel down and through the porous surface into an underlying rain gutter.

Figure 1:
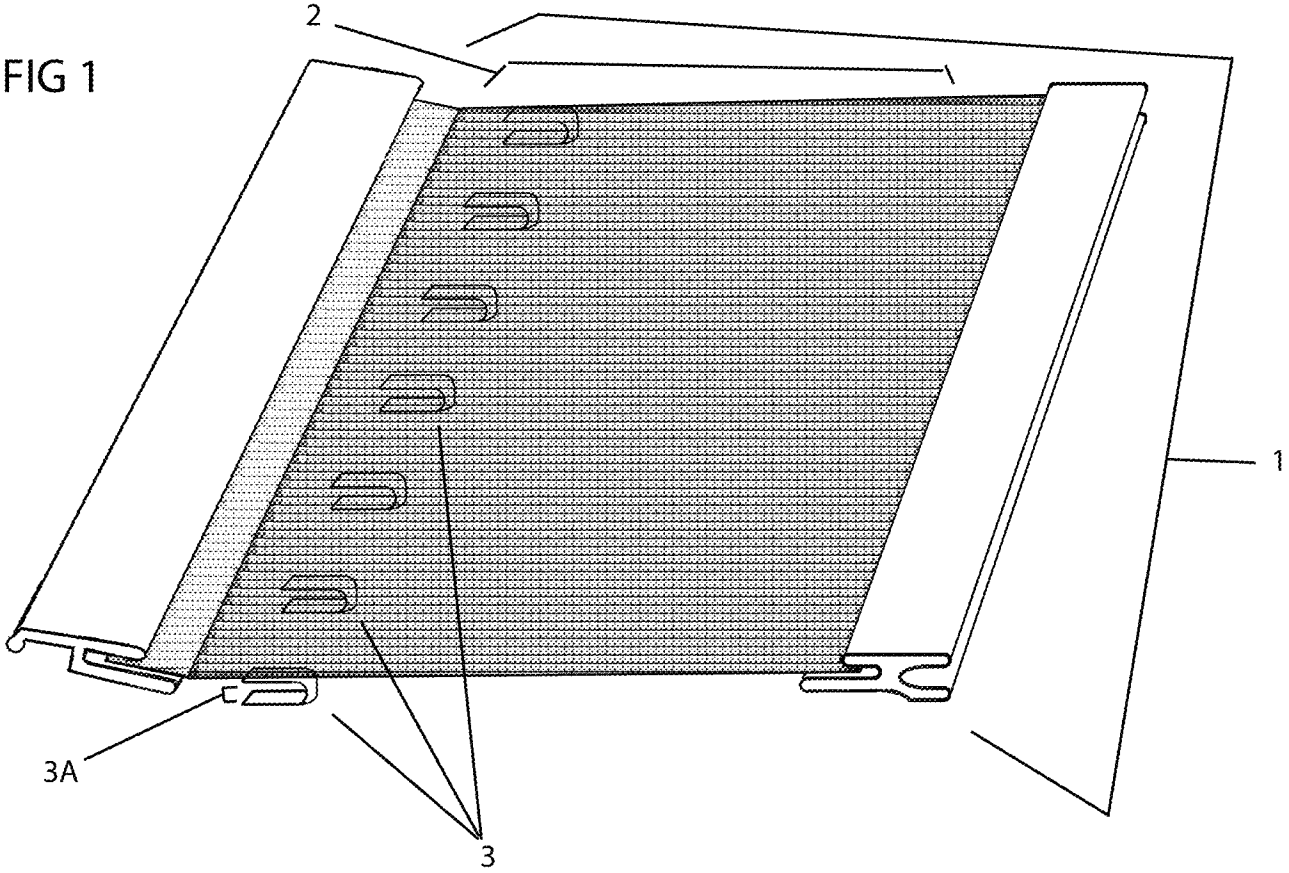
FIG. 1. A top view of a screened gutter guard with heat cable receiving clips installed on the underside of the screen FIG. 2. A view of a screened gutter guard, with heat cable receiving clips installed on the underside of the screen, installed in a rain gutter FIG. 3. A view of the rear section of a corrugated screened gutter guard with a heat receiving clip installed on the underside of the corrugated and views of three types of clips FIG. 4. A view of the rear section of a corrugated screened gutter guard with copper threads interwoven through the screen FIG. 5. A view of a clip whose rear tab is inserted through and installed within the openings of an expanded metal section of a gutter guard.
Figure 9:
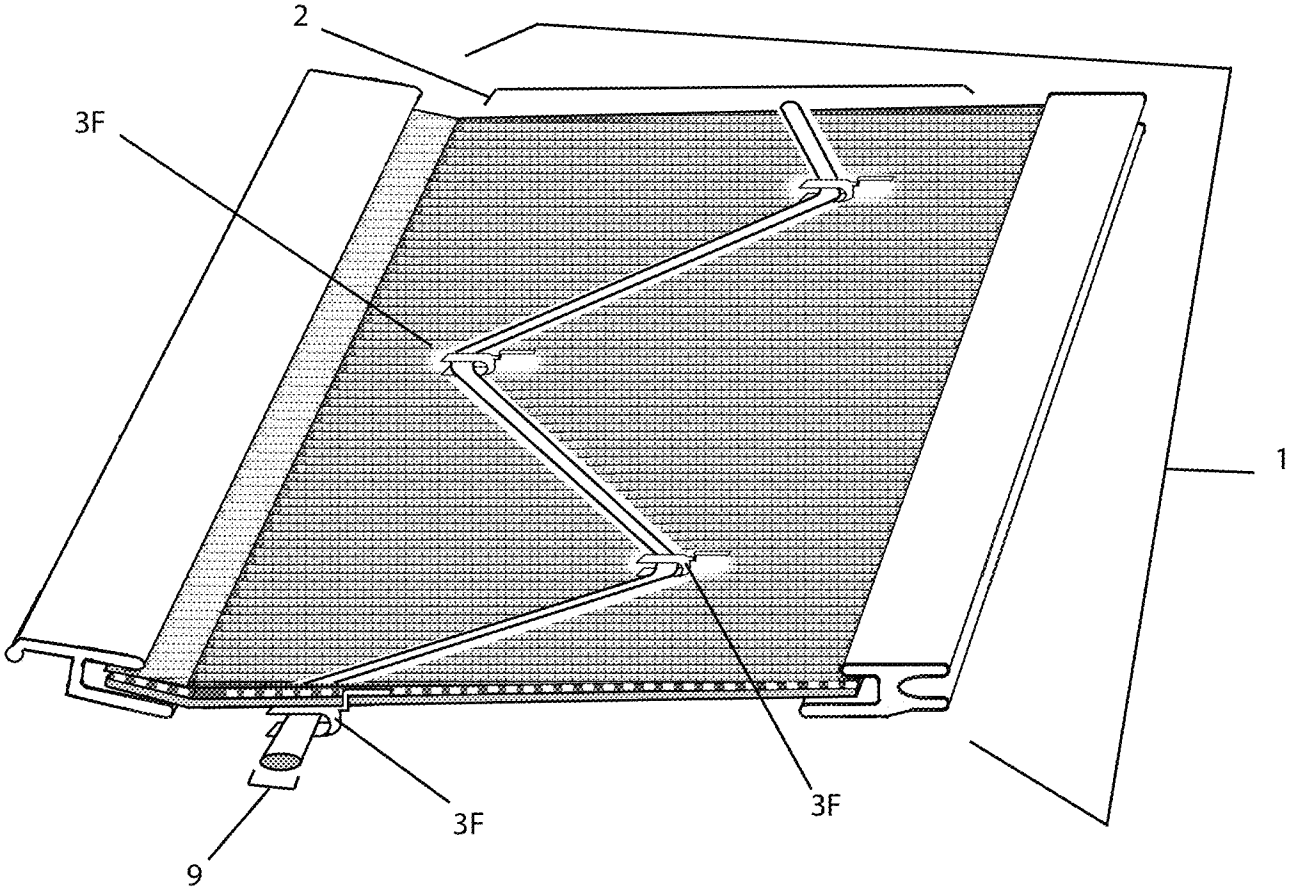
FIG. 9. A view of a gutter guard comprising a fine mesh screen overlying an expanded metal support skeletal structure illustrating the rear tab of clips inserted in zig-zag pattern into and through expanded metal openings existent on the lower expanded metal plane of the gutter guard.

Referring to (FIG. 9), it is illustrated that the clips 3F may be positioned in a staggered fashion allowing a heating cable 9 to provide patterns of heat radiation on the underplane or underside of a gutter guard 1 rather than distributing the heat in a single linear plane as would occur in (FIG. 1).

Figure 10:
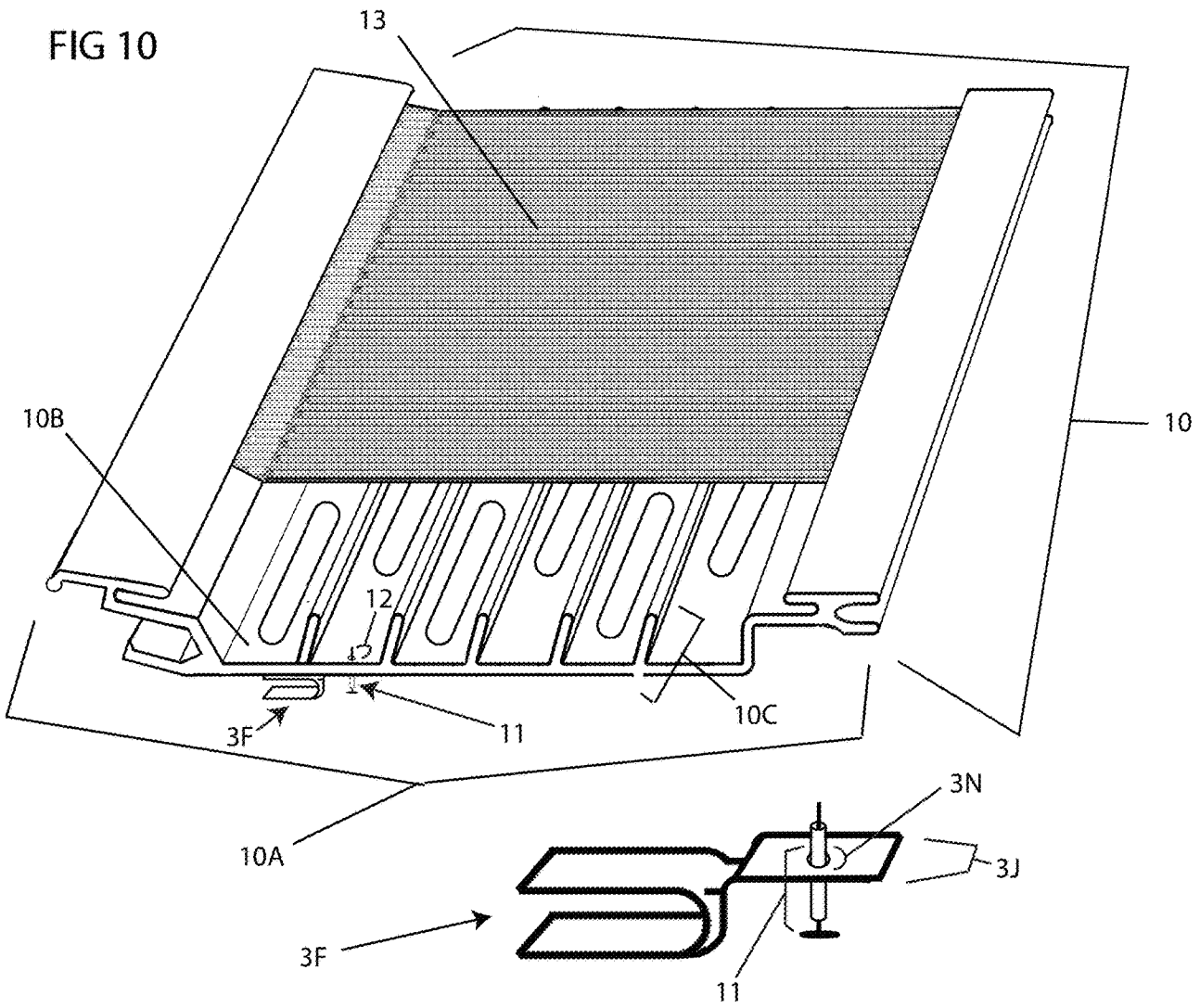
FIG. 10. A view of a solid body gutter guard with overlying screen mesh such gutter guard body having clips pop-riveted to the underside of its lowermost plane.

Referring to (FIG. 10), there is illustrated a gutter guard 10 with a solid, extruded or roll formed, body 10A that comprises a perforated plane 10B from which rises upward extending planes 10C which are overlain by a screen of filtering membrane 13.

Referring to (FIG. 3), there is illustrated a copper, or zinc, or other material clip 3D or staple that may be stapled or inserted through a top member or plane or corrugated screen 2A and serve as a copper-ion or other material dispersing medium to aid in the prevention or elimination of moss or mold or mildew buildup on the water receiving areas of a gutter guard 2A. Although simply stapling copper or zinc or other material clips or staples is easily achieved, it is not found and has not been proposed in prior art. Stapling copper into the body of many thin-bodied or screened gutter guards is easily accomplished during manufacture or as retrofit on already installed gutter guard products. During prototype, I simply used a desk-top stapler to fasten staples into the screened water-receiving area of a product sold as Master Shield®. In the Popular Mechanics® publication "500 Simple Home Repair Solutions" the following excerpt is found on page 19: "According to the Washington State Cooperative extension, copper or galvanized ridges on the roof are often effective in keeping moss under control for about 10 feet down from the ridge. If a copper wire is stretched horizontally across a roof, the corrosive leeching of the copper should also provide moss control for about 46 feet down. You can control moss by stretching their copper wire horizontally about every 5 feet along the butts of the shingles. Also stretch a copper wire along the ridge. Rain and snow melt will carry the leaches from the copper wire down the roof. Copper leachate is corrosive to metal, so protect the inside a steel gutters with gutter paint. Not only is moss on a roof ugly, but it can grow so vigorously that it raises and loosens shingles, making the roof vulnerable to water penetration during a driving rain or snow melt." In view of the Popular Mechanics findings: a simple thread or strand of copper wire woven into a screener water receiving mesh of a gutter guard or adhered to a gutter guard body or any area and immediately preceding the water receiving area of the gutter guard will serve to prevent moss or mold or mildew growth. The methods I teach for achieving this in a gutter guard as retrofit or during manufacture of other than solid copper gutter guards is not taught in prior art or present in the field. When combining copper with other metals a ratio must be kept in mind to prevent over corroding and clogging of the remainder of the gutter guard, especially its water receiving areas. I teach not to exceed an amount of copper that comprises more than 30% of the top surface areas of the gutter guard. However, as noted in popular mechanics, a simple single thread of copper should suffice for killing Moss mold or mildew on a gutter guard.

Figure 4:
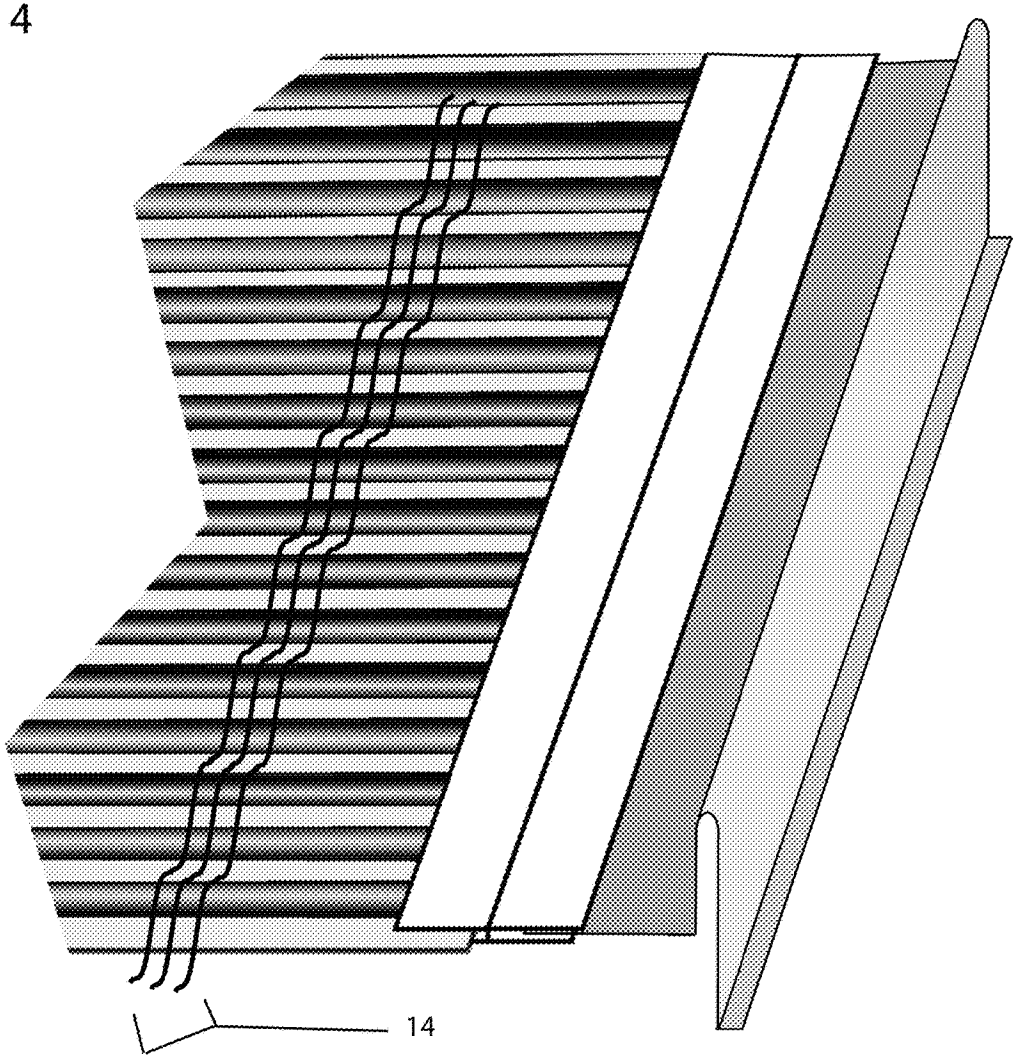

Referring to (FIG. 4) 14: another means of achieving copper-ion dispersal is by inter weaving or embroidering copper thread or threads in screen or micro-mesh material. Utilizing an all copper screen leads to the screens eventual failure to receive water due to corrosion but, when the copper is limited and made a lesser part of another screening cloth, much of the oxidation and corrosion itself is washed over the remainder of the screen that is not copper and down through its openings, washing away both the corrosion and moss and mold spores that have been killed by the copper thereby disallowing them from "taking root" in the screen or gutter guard body.

Referring again to (FIG. 8) there is illustrated a hole or grommet 15 present in the water receiving area 2 of the gutter guard through which a heating or other cable may be drawn or through which elements or agents may be inserted or dispersed down into an underlying gutter. Also illustrated is a cap or cover 16 for the hole or grommet that may remain inserted into the hole or grommet until such time as the opening is needed. The cover or covering method 16 may also be intrinsic to the grommet in a manner similar to garbage disposal rubber stops that are slit and existent in the drain opening: normally remaining closed but able to separate at the slits and allow for debris to be pushed through, then reclosing. The grommet is preferred to a simple hole or other protrusions even if inserted into a solid surface since it prevents rough edges from adversely affecting any cable pulled through.

The scope of this invention is not limited to the positioning of the clips: "open face forward" or to the types of clips illustrated. Hundreds of clip configurations and dozens of securing methods as well as clip locations are possible; many found in disclosed and patented prior art. What is presented in this application as "new art" is the utilization of clips fastened to the underside of gutter guard devices or drip edges to allow for the installation of heating cables or other elements. No instance of clip usage in a gutter guard or a drip edge in this manner is known to the applicant in prior art or currently being employed in the field.

The scope of this invention is not limited to the utilization of copper threads sewn or attached or adhered into filtering cloth or screens or embroidered into, or on top of, filtering cloth or screens or to copper or zinc staples being stapled into a filtering cloth or screen or thin solid body of a gutter guard: the utilization of copper in limited amounts throughout the water receiving area of a gutter guard is being presented as unique for the reasons disclosed in this application.

REFERENCE NUMERALS

1. Gutter Guard with a screened main body and water receiving area
1A. Rear lateral edge of a gutter guard
1B. Front lateral edge of a gutter guard
1C. Cut-a-way rear section of a gutter guard
2. Screen serving as the main body and water receiving area of a gutter guard
2A. Corrugated screen serving as the main body and water receiving area of a gutter guard
2B. Screen over expanded metal serving as the main body and water receiving area of a gutter guard
3. Clip or clips
3A. Open end of a clip
3B. Clip with an upward extending and piercing tab
3C. Upward extending and piercing tab
3D. Clip with downward extending and piercing side members
3E. Downward extending side members
3F. Clip with a dual-level tab
3G. Dual level tab component of a clip
3H. Lower plane of dual level tab component of a clip
3I. Upward extending plane of dual level tab component of a clip
3J. Upper plane of dual level tab component of a clip
3K. Laterally extending plane of a clip
3L. Laterally extending plane of a clip
3M. Upper plane of a clip
3N. Perforation in upper plane of a dual level tab component of a clip
3O. Clip made of screen or other water permeable material
4. Rain Gutter
4A. Front Top Lip of rain gutter
4B. Open air space that exists during installation between front top lip of rain gutter and bottom surface of the front lateral edge of a gutter guard.
5. Shingles or Roof covering
6. Roof underlayment
7. Expanded metal
8. Expanded metal opening or perforation in a gutter guard
9. Heating cable
10. Solid body gutter guard
10A. Extruded or roll formed body
10B. Perforated plane
10C. Upward extending planes
11. Pop-rivet
12. Perforation to accommodate insertion of pop rivet sleeve
13. Filtering screen or membrane
14. Copper or zinc thread(s)

What is claimed is:

1. A gutter guard for filtering water that enters a rain gutter on a building, the gutter guard comprising:
a barrier member configured to be positioned above a lowest portion of the rain gutter and having a plurality of openings through which the water can penetrate the barrier member and enter the rain gutter, the barrier member having
first members that extend along a first direction;
second members that extend along a second direction that is non-parallel to the first direction; and
third members that extend along the second direction,
wherein the first members are made of a first material,
the second members are made of the first material,
the third members are made of a second material,
the first material and the second material are different materials,
the second material is an ion-dispersing material,
the barrier member is a single-layer mesh, and
the single-layer mesh comprises the first members, the second members, and the third members.

2. The gutter guard of claim 1, wherein the second material is a metal.

3. The gutter guard of claim 2, wherein the second material is copper or zinc.

4. The gutter guard of claim 1, wherein the second material comprises a thread of copper or zinc.

5. The gutter guard of claim 3, wherein the second material forms no more than 30 percent of the barrier member.

6. The gutter guard of claim 2, wherein the first material is a non-metal.

7. The gutter guard of claim 1, wherein the first material is a non-metal.

8. The gutter guard of claim 1, wherein the first material forms a majority of the barrier member.

9. The gutter guard of claim 1, wherein the second material forms no more than 30 percent of the barrier member.

10. The gutter guard of claim 3, wherein the single-layer mesh is a woven mesh in which the second members are interwoven with the first members, and the third members are interwoven with the first members.

11. The gutter guard of claim 10, wherein the second material comprises a thread of copper or zinc.

12. A filtration device, comprising:
a barrier member having a plurality of openings through which a fluid can penetrate the barrier member, the barrier member having
first members that extend along a first direction;
second members that extend along a second direction that is non-parallel to the first direction; and
third members that extend along the second direction,
wherein the first members are made of a first material, the second members are made of the first material, the third members are made of a second material, the second material is an ion-dispersing material, the first material and the second material are different materials, the barrier member is a single-layer mesh, and the single-layer mesh comprises the first members, the second members, and the third members.

13. The filtration device of claim 12, wherein the second material is a metal.

14. The filtration device of claim 12, wherein the second material forms no more than 30 percent of the barrier member.

15. The filtration device of claim 12, wherein the first direction is substantially perpendicular to the second direction.

16. The gutter guard of claim 1, wherein the first direction is substantially perpendicular to the second direction.

17. The gutter guard of claim 1, wherein the barrier member is configured such that the second direction is parallel to a longitudinal direction of the rain gutter.

* * * * *